US005566619A

United States Patent [19]

Theurer

[11] Patent Number: 5,566,619

[45] Date of Patent: Oct. 22, 1996

[54] METHOD AND APPARATUS FOR REHABILITATING THE SUBGRADE SUPPORTING A BALLAST BED

[75] Inventor: Josef Theurer, Vienna, Austria

[73] Assignee: Franz Plasser Bahnbaumaschinen-Industriegesellschaft M.B.H., Vienna, Austria

[21] Appl. No.: 551,183

[22] Filed: Oct. 31, 1995

[30] Foreign Application Priority Data

Nov. 15, 1994 [AT] Austria ..... 2109/94

[51] Int. Cl.[6] ..... E01B 27/00

[52] U.S. Cl. ..... 104/2; 37/104; 171/16

[58] Field of Search ..... 104/2, 7.1, 12; 37/104; 171/16

[56] References Cited

U.S. PATENT DOCUMENTS

| | | | |
|---|---|---|---|
| 3,957,000 | 5/1976 | Plasser et al. | 104/2 |
| 4,357,874 | 11/1982 | Theurer | 104/2 |
| 4,479,439 | 10/1984 | Theurer et al. | 104/2 |
| 5,257,580 | 11/1993 | Theurer et al. | 104/2 |
| 5,394,944 | 5/1995 | Theurer et al. | 104/2 |
| 5,456,180 | 10/1995 | Theurer et al. | 104/2 |

FOREIGN PATENT DOCUMENTS

| | | |
|---|---|---|
| 9306779 | 8/1993 | Germany . |
| 4301182 | 7/1994 | Germany . |
| 4343148 | 10/1994 | Germany . |

OTHER PUBLICATIONS

Internationaler Eisenbahnverband (International Railroad Union) Jan. 1, 1990, p. 11—UIC–Kodex 722E.

*Primary Examiner*—S. Joseph Morano
*Attorney, Agent, or Firm*—Collard & Roe, P.C.

[57] ABSTRACT

The subgrade supporting a ballast bed for a track is rehabilitated by (a) lifting the track off the ballast bed, removing an upper,portion of the ballast from the ballast bed, comminuting the removed ballast to obtain gravel, storing the gravel, and laying the track on a remaining portion of the ballast bed, in a first stage, (b) lifting the track off the remaining ballast bed portion, removing the ballast of the remaining ballast bed portion until the subgrade is exposed, and laying the track on the exposed subgrade, in a second stage, and (c) lifting the track off the subgrade, discharging the stored gravel on the subgrade, planing and compacting the gravel on the subgrade until a protective layer for the subgrade is obtained, and laying the track on the protective subgrade layer, in a third stage.

6 Claims, 1 Drawing Sheet

METHOD AND APPARATUS FOR REHABILITATING THE SUBGRADE SUPPORTING A BALLAST BED

BACKGROUND OF THE INVENTION

1. Field of the Invention

The present invention relates to a method and an installation for rehabilitating the subgrade supporting a ballast bed for a track, wherein ballast from the ballast bed is comminuted to obtain gravel and the gravel is discharged on the exposed subgrade to produce a protective layer for the subgrade.

2. Description of the Prior Art

German utility model No G 93 06 779.8, published Aug. 26, 1993, discloses a track-bound car for processing ballast. This car is equipped with a rock breaking device for comminuting ballast and a screening device for separating the comminuted ballast into portions of coarser and finer gravel. The finer gravel portion is discharged as gravel for the subgrade and the coarser gravel portion is conveyed to an end of the car for storage in an adjoining freight car.

German patent application No. 4,301,182, published Jul. 21, 1994, describes a method of rehabilitating a ballast bed by removing ballast from the bed and at least partially replacing it with new ballast. The removed ballast is classified in grain sizes useful for a protective layer material for the subgrade and in grain sizes exceeding that range.

U.S. Pat. No. 4,479,439 discloses a method and installation for improving a track bed, wherein a protective layer of a gravel-sand mixture is laid between the subgrade and the ballast in a continuous manner. The installation comprises a vertically adjustable ballast excavating device mounted between two undercarriages and a conveyor arrangement for receiving and discharging the excavated ballast. A discharge end of a conveyor arrangement for the sand forming the protective layer is arranged immediately behind the ballast excavating device, in the operating direction. A discharge end of a further conveyor arrangement for new ballast is arranged behind the discharge end of the sand conveyor arrangement. The track is lifted off the track bed about centrally between the undercarriages, and the encrusted ballast below the lifted track is continuously removed by the excavating device. At the same time, sand is continuously discharged on the track and is laid on the exposed subgrade as it falls between the track ties. The protective layer is compacted and the new ballast is discharged on the compacted layer and planed.

Another method and installation for improving a track bed is described in U.S. Pat. No. 4,357,874. This installation comprises two independently advancing track working machines. Each machine comprises a bridge-like machine frame which, at one end, has an off-track undercarriage arranged between two on-track undercarriages. Subgrade rehabilitation is initiated by the first machine by lifting an assembled track section to expose a trackless renewal section. The second machine then removes the encrusted ballast from the trackless renewal section, and the first machine is used again to lay a protective sand layer on the subgrade and new ballast on the protective sand layer. This system is particularly useful for the rehabilitation of short track sections.

U.S. Pat. No. 5,257,580 discloses yet another arrangement and method for producing a protective layer on the subgrade of a track. This installation, too, has two independent track working machines, the first one of which is equipped with a ballast excavating device and the second one of which carries a track lifting device as well as a planing and compacting device.

Another method for rehabilitating a track bed subgrade is known from UIC-Codex 722 E of the Internationaler Eisenbahnverband (International Railroad Union), page 11, dated Jan. 1, 1990. According to this method, encrusted ballast is completely removed by a ballast cleaning machine in a first .step. The excavated ballast is partially stored on the shoulder or in suitable silo cars. In a subsequent step, the exposed subgrade is planed, a textile layer is optionally placed on the exposed subgrade, and the track is laid thereon. Subsequently, a gravel-sand mixture is discharged from the car and is leveled by a planing device. Afterwards, a track tamping, leveling and lining machine is moved into position to lift the track and to tamp the gravel-sand mixture under the ties with specially enlarged tamping picks. Thereafter, the track is raised, ballast is discharged, and the ties are tamped in conjunction with a correction of the track position.

SUMMARY OF THE INVENTION

It is a primary object of this invention to provide a method and apparatus of the first-described type, which assures an economical track subgrade rehabilitation with machines that may be used in other track work.

The above and other objects are accomplished according to one aspect of the invention with a method for rehabilitating the subgrade supporting a ballast bed for a track, which comprises the steps of (a) lifting the track off the ballast bed, removing an upper portion of the ballast from the ballast bed, comminuting the removed ballast to obtain gravel, storing the gravel, and laying the track on a remaining portion of the ballast bed, in a first stage, (b) lifting the track off the remaining ballast bed portion, removing the ballast of the remaining ballast bed portion until the subgrade is exposed, and laying the track on the exposed subgrade, in a second stage, and (c) lifting the track off the subgrade, discharging the stored gravel on the subgrade, planing and compacting the gravel on the subgrade until a protective layer for the subgrade is obtained, and laying the track on the protective subgrade layer, in a third stage.

According to another aspect of the present invention, there is provided an installation for rehabilitating the subgrade supporting a ballast bed for a track and producing a protective layer for the subgrade, which comprises (a) a first group of machines comprising a ballast excavating machine including a continuously revolvable ballast excavating chain and a device for lifting the track off the ballast bed, a car equipped with a rock breaking device for comminuting the excavated ballast to obtain gravel, a freight car for storing the gravel, and a conveyor arrangement for conveying the excavated ballast from the excavating chain to the rock breaking device and for conveying the gravel from the rock breaking device to the freight car, (b) a second group of machines comprising a ballast excavating machine including a continuously revolvable ballast excavating chain, a freight car for storing the ballast, and a conveyor arrangement for conveying the excavated ballast from the excavating chain to the freight car, and (c) a third group of machines comprising a device for lifting the track, a freight car for storing the gravel, a machine for discharging the gravel on the subgrade, a conveyor arrangement for conveying the gravel from the freight car to the gravel discharging machine, and a device for planing and compacting the gravel on the subgrade until a protective subgrade layer is obtained.

The three-stage procedure enables the speeds of the material conveyances and the continuous work progress to be rapidly and optimally conformed to the prevailing operating conditions. Furthermore, it provides the economically advantageous possibility to use track working machines operable for other track work for the removal of ballast from an encrusted ballast bed and the laying of the protective layer on the subgrade.

BRIEF DESCRIPTION OF THE DRAWING

The above and other objects, advantages and features of this invention will become more apparent from the following detailed description of a now preferred embodiment thereof, taken in conjunction with the accompanying schematic drawing wherein.

DETAILED DESCRIPTION OF THE PREFERRED EMBODIMENT

Figure 1:
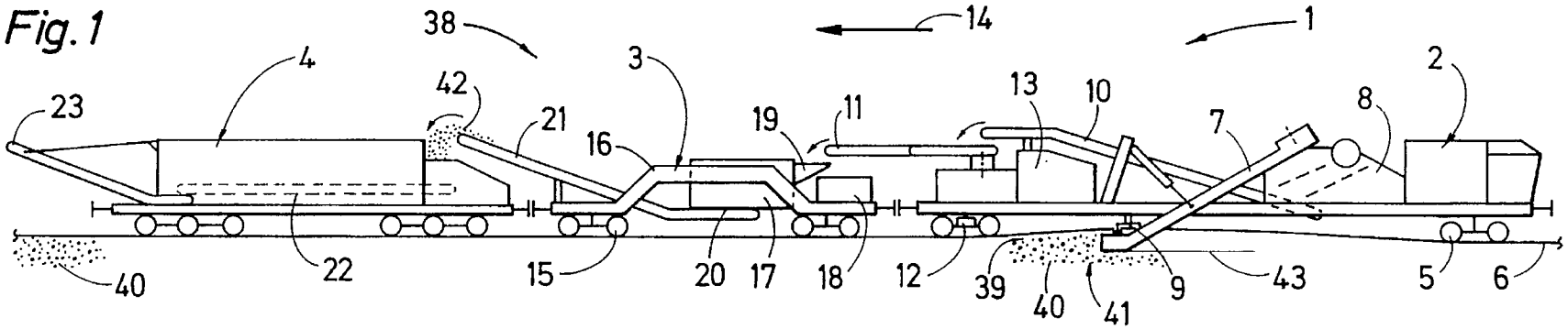
FIG. 1 shows a side elevational view of a first machine group for removing an upper portion of the ballast bed, conveying the removed ballast to a rock breaking car, comminuting the removed ballast and storing the resultant gravel.

The drawing illustrates installation 38 for rehabilitating subgrade 44 supporting ballast bed 41 for track 6 and producing protective layer 45 for the subgrade. As shown in FIG. 1, this installation comprises a first group 1 of machines comprising ballast excavating machine 2, car 3 equipped with rock breaking device 17 for comminuting the excavated ballast to obtain gravel, and at least one freight car 4 for storing the gravel. The ballast excavating machine includes continuously revolvable endless ballast excavating chain 7, which passes underneath the track into the ballast, ballast screening device 8 and vertically adjustable device 9 for lifting track 6 off ballast bed 41. The ballast excavating machine is propelled by drive 12, and central power plant 13 supplies energy to all the drives on the machine. The illustrated machine with screening device 8 is a conventional ballast cleaning machine but, if desired, a pure excavating machine without a ballast screening arrangement may be used.

Conveyor arrangement 10 has an input end underneath screening device 8 and output end 11 projecting beyond a forward end of the ballast excavating machine, in an operating direction indicated by arrow 14, for conveying the excavated ballast from excavating chain 7 to inlet opening 19 of rock breaking device 17. Car 3 immediately precedes the ballast excavating machine in the operating direction and comprises machine frame 16 supported on track 6 by undercarriages 15 and carrying rock breaking device 17 and energy-supplying plant 18. Gravel 42 leaving the rock breaking device through outlet opening 20 is conveyed from rock breaking device 17 to freight car 4 by conveyor arrangement 21 whose output end projects beyond a forward end of car 3 which is preceded by freight car 4, in the operating direction.

The bottom of freight car 4 is formed by conveyor band 22 extending in a longitudinal direction and leading to transfer conveyor band 23 projecting beyond a forward end of the freight car. Such box cars are known and may be used in a train of like box cars to unload stored bulk material automatically and to transfer the unloaded bulk material from car to car.

Figure 2:
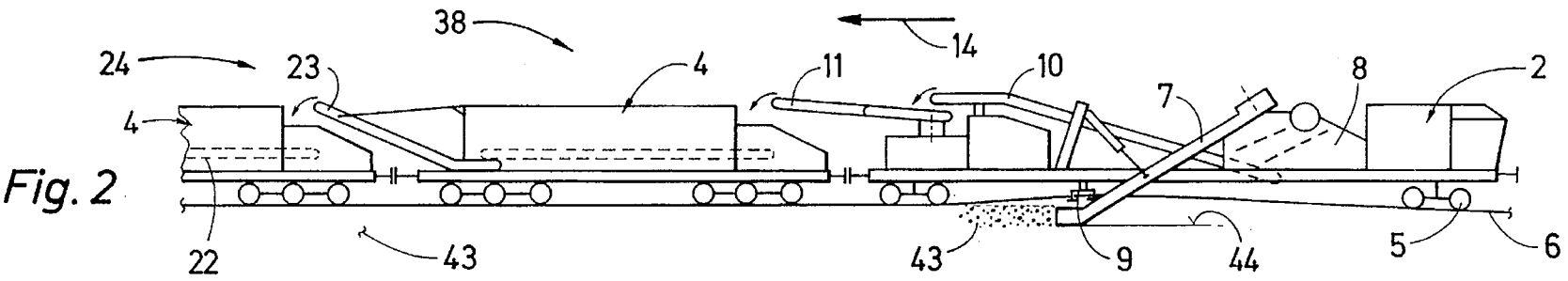
FIG. 2 shows a side elevational view of a second machine group for removing the remaining portion of the ballast bed and storing the removed ballast.

FIG. 2 illustrates second group 24 of machines comprising a ballast excavating machine 2, as described in connection with FIG. 1, and a series of freight cars 4, as described hereinabove, for storing the ballast. Obviously, different types of ballast excavating machines and/or ballast storage cars may be used in the second group of machines. Conveyor arrangement 10, 22, 23 conveys the excavated ballast from excavating chain 7 to freight cars 4.

Figure 3:
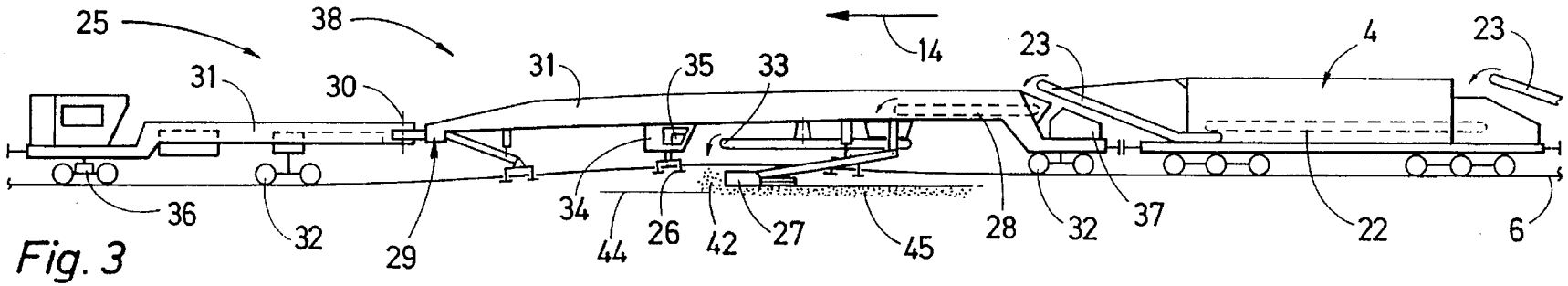
FIG. 3 shows a side elevational view of a third machine group for discharging the stored gravel on the exposed subgrade, and for planing and compacting the gravel on the subgrade.

A third group 25 of machines is illustrated in FIG. 3, and this group comprises vertically adjustable device 26 for lifting the track, a series of freight cars 4 for storing the gravel, machine 29 for discharging gravel 42 on subgrade 44, conveyor arrangement 28 for conveying the gravel from the freight cars to gravel discharging machine 29, and device 27 for planing and compacting the gravel on the subgrade until a protective subgrade layer is obtained. Gravel discharging machine 29 has machine frame 31 supported on track 6 by undercarriages 32 and comprised of two parts linked to each other by pivot 30 enabling the two machine frame parts to swivel about a vertical axis. Operator's cab 34 is mounted underneath machine frame 31 in view of discharge end 33 of conveyor arrangement 28, and central control 35 is arranged in cab 34. Gravel discharging machine 29 is propelled by drive 36 and carries central power plant 37 for supplying energy to the drives on the machine.

The operation of installation 38 comprised of the three machine groups 1, 24 and 25 will now be described to illustrate the method for rehabilitating subgrade 44 supporting ballast bed 41 for track 6 in accordance with the present invention.

In a first stage, shown in FIG. 1, track 6 is slightly lifted off ballast bed 41 by device 9, and an upper portion 39 of ballast 40 is removed from the ballast bed by continuously revolving ballast excavating chain 7. Level 43 of upper ballast portion 39 depends on the amount of gravel produced therefrom and required for the layer of gravel desired to be laid on subgrade 44. The removed ballast may be conveyed by conveyor arrangement 10 directly from the ballast excavating chain to input opening 19 of rock breaking device 17 for comminution to obtain gravel 42, or, as shown, the removed ballast may first be cleaned in screening arrangement 8 before it is comminuted. The gravel is conveyed by conveyor arrangement 21 to preceding freight car 4 where it is stored. As the machine group advances in the operating direction indicated by arrow 14, track 6 is automatically laid on remaining portion 43 of ballast bed 41 just ahead of rear undercarriage 5 of the ballast excavating machine.

The subsequent second operating stage is illustrated in FIG. 2 in connection with machine group 24. Track 6 is lifted off remaining ballast bed portion 43, the ballast of the remaining ballast bed portion is removed by ballast excavating chain 7 of ballast excavating machine 2 until subgrade 44 is exposed. Usefully, a thickness of subgrade 44 corresponding to the thickness of protective layer 45 to be laid in the third stage is removed from the subgrade with remaining ballast bed portion 43. The removed ballast is conveyed to freight cars 4 by conveyor arrangement 10. Again, immediately ahead of rear undercarriage 5 of the ballast excavating machine, track 6 is laid on exposed subgrade 44.

In the third stage illustrated in FIG. 3, third machine group 25 is also advanced continuously along the track, just as the first and second machine groups during the first and second stages of the subgrade rehabilitation method. During the third stage, track lifting device 26 of continuously advancing gravel discharging machine 29 lifts track 6 off subgrade 44, while gravel stored in freight car 4, which was filled with gravel during the first stage, is conveyed to the gravel discharging machine by conveyor arrangement 28, which includes conveyors 22 and 23. Gravel 42 is discharged at output end 33 of the conveyor arrangement on subgrade 44, and the gravel is planed and compacted on the subgrade by planing and compacting device 27 until protective layer 45 for the subgrade is obtained. Immediately ahead of rear undercarriage 32 of gravel discharging machine 29, track 6 is laid on protective subgrade layer 45.

In a further track rehabilitation stage not illustrated herein and being generally conventional, new ballast is delivered to the track bed to provide a new ballast bed on top of protective subgrade layer 45. Gravel discharging machine 29 supplied with new ballast, instead of gravel, from freight cars 4 may be used for this purpose. In other words, the third operating stage of the subgrade rehabilitation method is essentially repeated with the laying of a ballast, instead of a gravel, layer to provide a new ballast bed.

If desired, the gravel received from rock breaking device 17 may be mixed with sand before it is delivered to gravel discharging machine 29, and the resultant mixture is then discharged on subgrade 44 to form protective layer 45. Also, exposed subgrade 44 may be compacted after remaining ballast portion 43 of ballast bed 41 has been removed. Alternatively to the manner of discharge of gravel illustrated in FIG. 3, it is also possible to discharge the gravel between the track rails on track 6 resting on subgrade 44 after the completion of the second stage. In the third stage, track 6 is lifted by track lifting device 27 of gravel discharging machine 29 and is discharged by gravity through the track cribs onto subgrade 44. Any gravel remaining on the track ties is then swept off the track after it has been lifted off the subgrade.

What is claimed is:

1. A method for rehabilitating the subgrade supporting a ballast bed for a track, which comprises the steps of (a) lifting the track off the ballast bed, removing an upper portion of the ballast from the ballast bed, comminuting the removed ballast to obtain gravel, storing the gravel, and laying the track on a remaining portion of the ballast bed, in a first stage, (b) lifting the track off the remaining ballast bed portion, removing the ballast of the remaining ballast bed portion until the subgrade is exposed, and laying the track on the exposed subgrade, in a second stage, and (c) lifting the track off the subgrade, discharging the stored gravel on the subgrade, planing and compacting the gravel on the subgrade until a protective layer for the subgrade is obtained, and laying the track on the protective subgrade layer, in a third stage.

2. The method of claim 1, comprising the step of cleaning the removed ballast of the ballast bed upper portion before it is comminuted.

3. The method of claim 1, comprising the step of mixing the gravel with sand.

4. The method of claim 1, comprising the step of compacting the exposed subgrade.

5. The method of claim 1, comprising the steps of discharging the stored gravel on the track resting on the subgrade after the second stage, and discharging the stored gravel by gravity from the track through the track cribs of the track lifted in the third stage and by sweeping gravel off the track after it has been lifted off the subgrade.

6. An installation for rehabilitating the subgrade supporting a ballast bed for a track and producing a protective layer for the subgrade, which comprises (a) a first group of machines comprising (1) a ballast excavating machine including a continuously revolvable ballast excavating chain and a device for lifting the track off the ballast bed, (2) a car equipped with a rock breaking device for comminuting the excavated ballast to obtain gravel, (3) a freight car for storing the gravel, and (4) a conveyor arrangement for conveying the excavated ballast from the excavating chain to the rock breaking device and for conveying the gravel from the rock breaking device to the freight car, (b) a second group of machines comprising (1) a ballast excavating machine including a continuously revolvable ballast excavating chain, (2) a freight car for storing the ballast, and (3) a conveyor arrangement for conveying the excavated ballast from the excavating chain to the freight car, and (c) a third group of machines comprising (1) a device for lifting the track, (2) the freight car for storing the gravel, (3) a machine for discharging the gravel on the subgrade, (4) a conveyor arrangement for conveying the gravel from the freight car to the gravel discharging machine, and (5) a device for planing and compacting the gravel on the subgrade until a protective subgrade layer is obtained.

* * * * *